United States Patent [19]

Ford et al.

[11] Patent Number: 4,496,085

[45] Date of Patent: Jan. 29, 1985

[54] DISPENSING PUMP FOR CONTAINERS WITH LARGE CLOSURES

[75] Inventors: John M. B. Ford, Lee's Summit; Donald D. Foster, Kingsville, both of Mo.

[73] Assignee: Realex Corporation, Kansas City, Mo.

[21] Appl. No.: 400,701

[22] Filed: Jul. 22, 1982

[51] Int. Cl.[3] ..... B05B 11/00

[52] U.S. Cl. ..... 222/321; 222/384; 222/153

[58] Field of Search ..... 222/153, 320, 321, 383, 222/385; 239/333

[56] References Cited

U.S. PATENT DOCUMENTS

| | | | |
|---|---|---|---|
| 989,435 | 4/1911 | Smallwood . | |
| 2,846,124 | 8/1958 | Stewart et al. . | |
| 2,870,943 | 1/1959 | Scoggin | 222/321 |
| 3,062,416 | 11/1962 | Cooprider . | |
| 3,179,306 | 4/1965 | Corsette | 222/321 |
| 3,257,961 | 6/1966 | Schlenker | 222/321 |
| 4,311,256 | 1/1982 | DeArmitt | 222/321 |
| 4,340,158 | 7/1982 | Ford et al. | 222/321 |
| 4,371,099 | 2/1983 | Foster et al. | 222/321 |

FOREIGN PATENT DOCUMENTS

| | | | |
|---|---|---|---|
| 202417 | 11/1955 | Australia | 222/385 |

*Primary Examiner*—Joseph J. Rolla
*Assistant Examiner*—Andrew Jones
*Attorney, Agent, or Firm*—Schmidt, Johnson, Hovey & Williams

[57] ABSTRACT

The pump is clamped to the top wall of a container closure by a pair of opposed, upper and lower clamping surfaces on the pump body which position the body to project down into the container. The lower clamping surface takes the form of a circular flange which is integral with the pump body and which is itself normally clamped between the top wall of the closure and the upper edge of the neck of the container when the neck is only slightly larger than the pump body, thereby preventing rotation of the body when the pump plunger is rotated to either lock or unlock the same from a fully depressed, stored position. When the pump is used on a large closure having a wide neck whose upper edge therefore fails to clamp against the pump flange, the pump body will nonetheless be held immobile by a series of flat surfaces therearound which matingly interlock with complimentally configured flat edges in the closure opening through which the pump body extends.

2 Claims, 9 Drawing Figures

Fig. 1
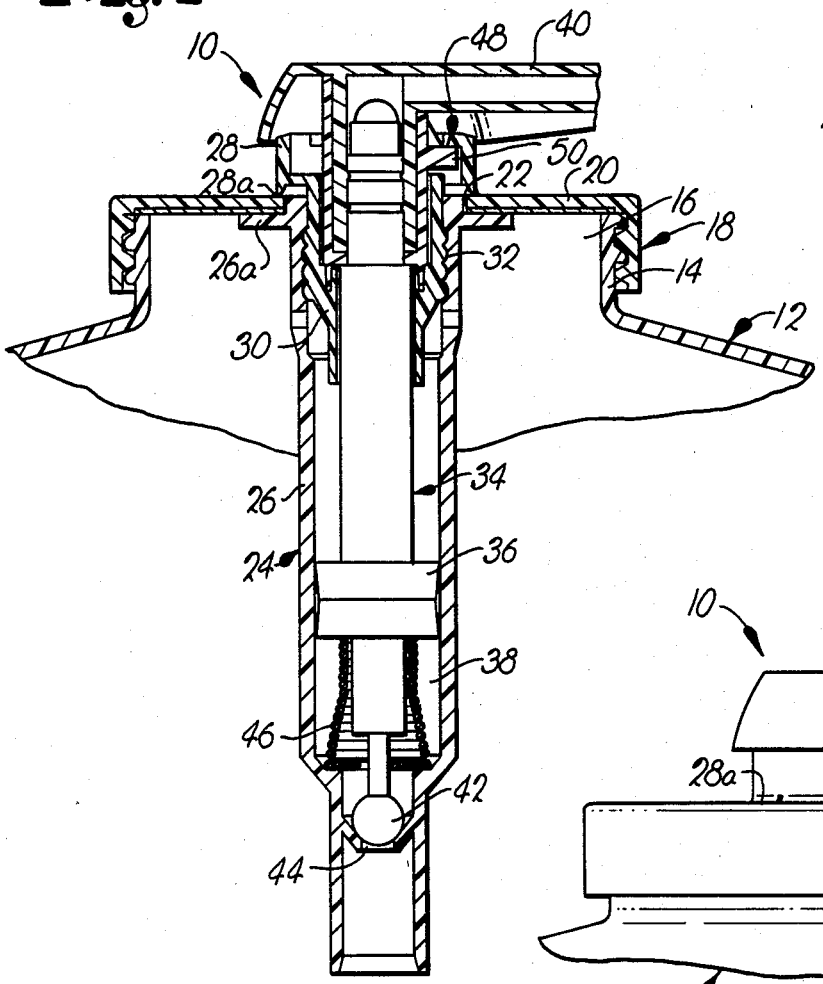
Fig. 2
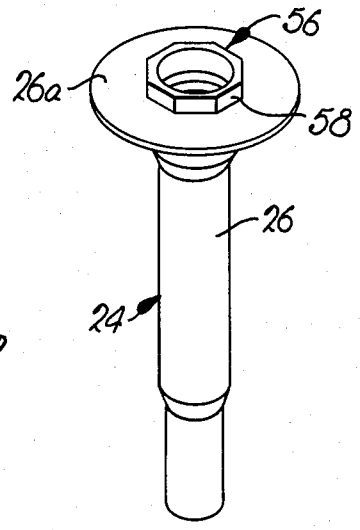
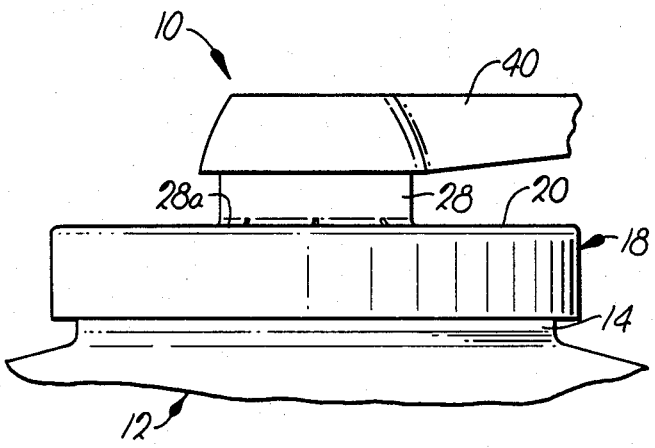
Fig. 3
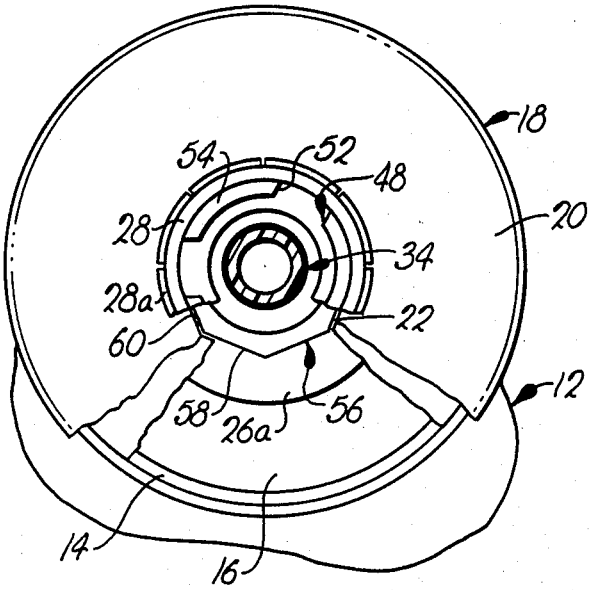
Fig. 7

Fig. 4 PRIOR ART
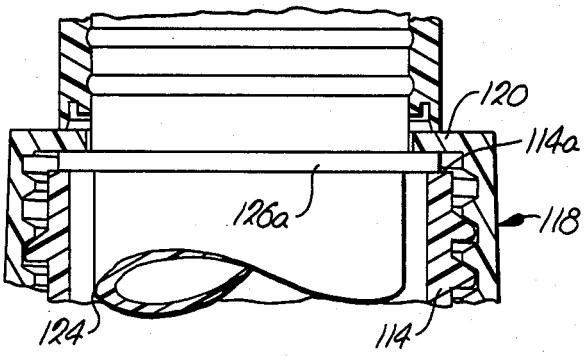
Fig. 6
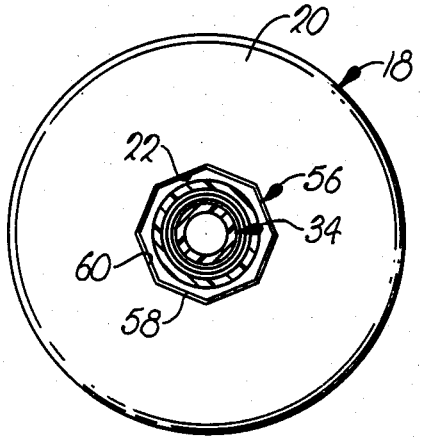
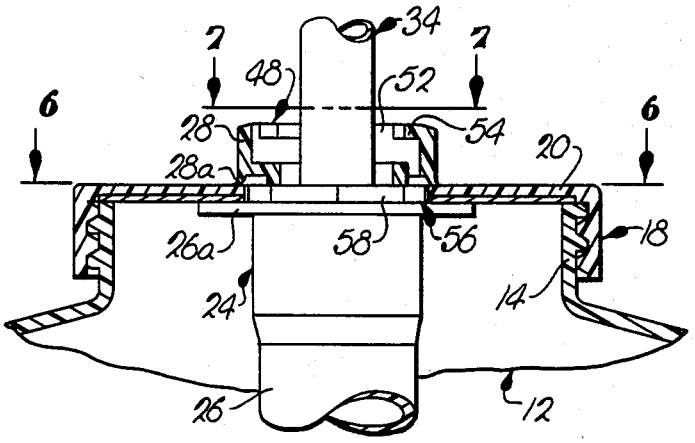
Fig. 5
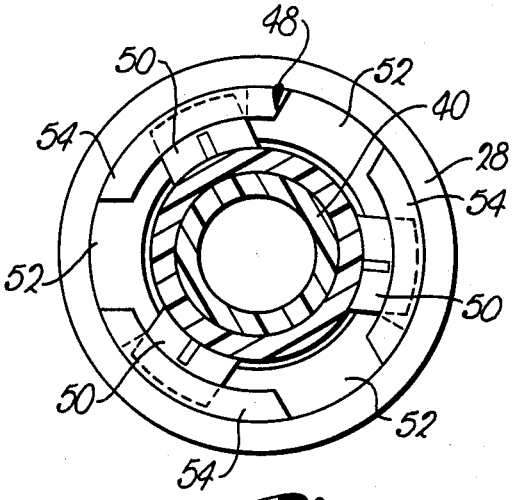
Fig. 9
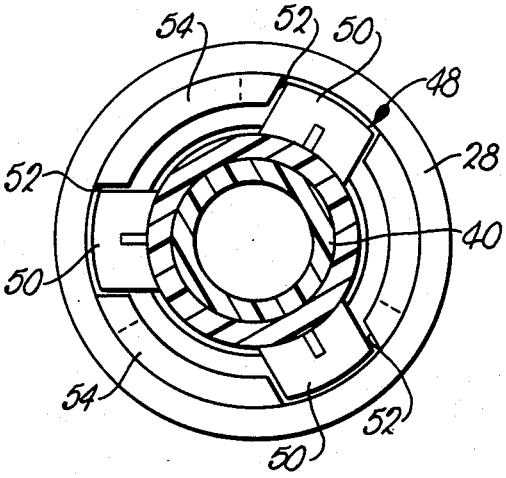
Fig. 8

DISPENSING PUMP FOR CONTAINERS WITH LARGE CLOSURES

TECHNICAL FIELD

This invention relates to hand-operated dispensing pumps of the type which are selectively lockable with their plungers in a fully depressed position and, more particularly, to an improvement which prevents relative rotation between the pump body and the closure with which it is associated during rotational locking and unlocking of the pump plunger.

BACKGROUND ART

Lock-down dispensing pumps typically rely upon the ability of the plunger to be rotated to a certain degree relative to locking structure on the pump body in order to engage and disengage the lock. In certain situations, however, it may not be possible to hold the pump body immobile using the common technique of clamping a rigid flange of the body between the closure and the upper edge of a neck on the container. Consequently, an important object of the present invention is to provide a way of rendering the pump body, and thus its associated lock structure, immobile relative to the plunger which does not rely upon that type of clamping action, inasmuch as it may or may not be available in any given situation.

SUMMARY OF THE PRESENT INVENTION

Pursuant to the foregoing, the present invention contemplates configuring the opening of the closure through which the pump extends in such a manner that it cooperates with correspondingly configured, exterior surfaces on the pump body to effectively interlock the pump body and the closure against relative rotation. This, then, assures that the plunger may be freely rotated to the extent necessary or desired during locking and unlocking without that portion of the lock which is on the pump body rotating with the plunger and thereby defeating the user's efforts to lock or unlock the pump.

BRIEF DESCRIPTION OF THE DRAWINGS

FIG. 1 is a fragmentary, vertical cross-sectional view of a pump mounted on a container and constructed in accordance with the principles of the present invention;

FIG. 2 is a front perspective view of the lower portion of the pump body illustrating the antirotational surfaces forming a part thereof;

FIG. 3 is a fragmentary elevational view of the pump and the container of FIG. 1;

FIG. 4 is a fragmentary, enlarged cross-sectional view of a pump and container illustrating the way in which prior art pumps may be held against rotation by clamping a flange on the pump body between the closure and the upper edge extremity of the neck on the container;

FIG. 5 is a fragmentary view of the container and pump with the container and certain portions of the pump shown in cross-section while other portions of the pump are shown in elevation to reveal details of construction;

FIG. 6 is a transverse cross-sectional view of the pump and associated closure of the container taken substantially along line 6—6 of FIG. 5;

FIG. 7 is a transverse cross-sectional view through the pump taken substantially along line 7—7 of FIG. 5 with portions of the pump, closure and container broken away to reveal details of construction;

FIG. 8 is an enlarged, transverse cross-sectional view through the lock of the pump illustrating the same in an unlocked mode but with the components thereof aligned just prior to locking; and FIG. 9 is a transverse cross-sectional view corresponding to FIG. 8 but with the lock components in a locked mode.

DETAILED DESCRIPTION

The pump 10 is illustrated in association with a container 12 having a wide neck 14 defining an outlet 16. A closure 18 threaded down onto the neck 14 has a top wall 20 provided with a centrally disposed opening 22 through which the pump 10 is inserted.

The pump 10 includes a tubular body 24 broadly comprising a lower portion 26 situated below the top wall 20 and extending down into the container 12 and an upper collar portion 28 situated primarily above the top wall 20. The upper portion 28 has a depending, tubular shank section 30 that is telescopically received within the lower portion 26 during initial installation of the pump 10 on the closure 18 so that a lower edge extremity **28*a* on upper portion 28 and a circular flange 26*a* on the lower portion 26 may serve as opposed clamping surfaces to grip the top wall 20 therebetween. Tightly interengaging beads and grooves 32 on the tubular section of upper portion 28 and lower portion 26 serve to hold the top wall 20 securely clamped between portions 26 and 28**.

The pump 10 further includes a plunger 34 confined for axial reciprocation within the tubular body 24 between extended and depressed positions. As will be well understood in the art, a piston 36 of the plunger 34 operates to successively draw liquid up into the chamber 38 of body 24 as the plunger 34 is extended and to then force such accumulation of liquid up through an internal passage of the plunger 34 (not shown) and out a discharge spout 40 thereof when the plunger 34 is thereafter depressed. A ball check valve 42 at the lower end of the chamber 38 opens and closes an inlet 44 to the latter in a manner well understood in the art, and a coil spring 46 between the piston 36 and the lower end of the chamber 38 yieldably biases the plunger 34 toward its fully extended position.

The plunger 34 and the upper portion 28 of body 24 are provided with a lock broadly denoted by the numeral 48 and shown in detail in FIGS. 8 and 9. Lock 48 is operable to releasably retain the plunger 34 in a fully depressed condition as illustrated in FIG. 1 and FIG. 3 and includes three radially outwardly projecting, circumferentially spaced-apart ears 50 on the plunger 34 and three upwardly facing, complementally configured notches 52 on the upper body portion 28. When ears 50 are aligned with the notches 52, the plunger 34 may be depressed and then rotated to bring the ears 50 underneath overhanging ledges 54 interspersed between the notches 52 whereby to hold the plunger 34 against extension.

Pursuant to the present invention the closure 18 and the body 24 are provided with interengaging structure broadly denoted by the numeral 56 locking the same against relative rotation. In this respect the structure 56 on body 24 includes a boss having a circumferentially extending series of flat surfaces 58 on the lower body portion 26 immediately above the flange **26*a*. In the preferred form, such surfaces 58, which each extend at a non-uniform distance from the central longitudinal axis of the pump 10 about which the plunger 34 may be rotated, describe an octagonal pattern, although it will be appreciated that other arrangements of surfaces at non-uniform distances from the axis of rotation of the plunger 34** may be provided within the scope of the present invention.

The structure 56 on closure 18 includes a series of mating edges 60 on the top wall describing and defining the limits of the opening 22, such edges 60 being complementally configured with respect to the surfaces 58 on pump body 24. As illustrated perhaps most clearly in FIG. 5, the flat surfaces 58 are so located on the pump body 24 that they are received within the opening 22 to thereby be in vertical alignment with the edges 60 thereof.

OPERATION

For purposes of illustration, a prior art arrangement has been shown in FIG. 4 wherein it will be noted that the flange 126*a* of the pump body 124 is clamped between the top wall 120 of closure 118 and the upper edge 114*a* of the container neck 114. Thus, the pump body 124 is securely held against rotation relative to the closure 120.

When the neck of a container is relatively wide, however, such as the neck 14 of container 12, then it may be seen as illustrated in FIGS. 1 and 5 that the flange 26*a* is too small in diameter to be clamped in place by the closure 18 and the container neck 14.

However, in the present invention it will be appreciated that the diameter or size of the container neck need be of no concern. Because of the locking-interengagement between the flat surfaces 58 on pump body 24 and the flat edges 60 on closure top wall 20, the pump body 24 is simply not permitted to rotate with the plunger 34 during locking or unlocking rotation thereof. Consequently, the pump 24 may be of standard size for all containers, regardless of the dimension of the necks on such containers.

We claim:

1. In combination with a container having an outlet circumscribed by a neck:

a closure secured to said neck in covering relationship to said outlet, said closure having a top wall provided with an opening therethrough; and a dispensing pump suspended from said closure into the interior of said container and including a tubular body passing through said opening, said pump further including a plunger reciprocable within said body and apparatus operably associated with said plunger for use in pumping products out of the container during successive strokes of the plunger, said body having a collar attached thereto adjacent the upper end of the body provided with a tubular shank portion inserted into the upper end of the body and an annular locking portion disposed above and against said top wall of the closure and projecting radially outwardly beyond the shank portion, said plunger being rotatable relative to the body and the collar and having a lock which is engageable and disengageable with said locking portion of the collar through said relative rotation for selectively retaining the plunger against actuation, said body including a flange projecting radially outwardly therefrom below and against the underside of said top wall of the closure, said flange having an outermost periphery spaced inwardly from said neck of the container, said top wall and said body having interengaging structure precluding rotation of the body relative to the closure during said rotation of the plunger to engage and disengage the lock, said structure including an annular boss at the upper end of said body projecting upwardly from said flange and received within said opening in the closure directly beneath said locking portion of the collar, said boss having an external surface within said opening disposed at a non-uniform distance from the axis of rotation of the plunger, said structure further including a mating edge on said top wall at least partially defining said opening and complementally engageable with said surface.

2. The combination as claimed in claim 1, wherein said surface is part of a series of like surfaces arranged in a circumferentially extending series about said boss and said edge is part of a series of like edges arranged in a circumferentially extending series about said opening.

* * * * *